US006315219B1

(12) United States Patent
Palestrant

(10) Patent No.: US 6,315,219 B1
(45) Date of Patent: Nov. 13, 2001

(54) MISTING-SYSTEM FLUID-ATOMIZATION MANIFOLD

(76) Inventor: Nathan Palestrant, 5120 N. 79th Pl., Scottsdale, AZ (US) 85250

( * ) Notice: Subject to any disclaimer, the term of this patent is extended or adjusted under 35 U.S.C. 154(b) by 0 days.

(21) Appl. No.: 09/693,748

(22) Filed: Oct. 20, 2000

(51) Int. Cl.[7] ..... B05B 1/14

(52) U.S. Cl. ..... 239/550; 239/207; 239/210; 239/266; 239/267; 239/548; 239/554; 239/558; 239/565; 239/589; 169/37

(58) Field of Search ..... 239/207, 210, 239/266, 267, 289, 548, 550, 554, 556, 557, 558, 559, 565, 567, 566, 589; 169/37

(56) References Cited

U.S. PATENT DOCUMENTS 3,270,966 * 9/1966 Ackley ..... 239/550
4,808,303 * 2/1989 Edwards et al. ..... 239/320 X
5,156,339 * 10/1992 Gibson et al. ..... 239/289
5,433,383 * 7/1995 Sundholm ..... 239/550 X
5,651,502 * 7/1997 Edwards ..... 239/550 X

* cited by examiner

*Primary Examiner*—Robin O. Evans
(74) *Attorney, Agent, or Firm*—Jordan M. Meschkow; Lowell W. Gresham; Mesckow & Gresham, P.L.C.

(57) ABSTRACT

A fluid-atomization manifold (50) for use in a misting system (20) configured to distribute a fluid (24) and to render that fluid (24) into a mist (26) is provided. The fluid-atomization manifold (50) has an input connector (54) coupled to a connector (44) of an interface fitting (36) coupled to fluid-distribution tubing (34) of the misting system (20). The fluid-atomization manifold (50) has a plurality of output connectors (56), wherein a connector (48) of each of a plurality of fluid-atomization nozzles (46) of the misting system (20) is configured to mate with the connector (44) of the interface fitting (36) and is coupled to one of the output connectors (56) of the fluid-atomization manifold (50). Within the fluid-atomization manifold (50), one of the output connectors (56) has an axis (66) substantially coincident with an axis (64) of the input connector (54) and others of the output connectors (56) have axes (66) symmetrically radially arranged at substantially identical angles (68) relative to the axis (64) of the input connector (54).

19 Claims, 6 Drawing Sheets

MISTING-SYSTEM FLUID-ATOMIZATION MANIFOLD

TECHNICAL FIELD OF THE INVENTION

The present invention relates to the field of misting systems. More specifically, the present invention relates to the field of manifolds for misting systems.

BACKGROUND OF THE INVENTION

Misting systems may be used to fulfill a plethora of functions, among which are: control of the environment of a greenhouse to aid in plant propagation; humidity control for fruit, vegetable, and wine storage; outdoor cooling for residential and commercial applications, including recreational use and animal husbandry; air filtration and dust abatement; and frost protection.

Such misting systems are distinct from sprinkling and/or spraying systems. Those skilled in the art will recognize that a misting system produces a mist, i.e., produces droplets small enough to be borne by the air. A cloud of water droplets is a mist if the droplets are less than 500 microns in diameter.

Droplets greater than 500 microns will precipitate, and therefore do not produce mist.

A misting system works by forcing water (or another fluid) through a specialized fluid-atomization (FA) nozzle (i.e., a misting nozzle) to produce a cloud of mist at a predetermined misting location. Those skilled in the art will appreciate that misting systems vary widely depending upon the characteristics of the system. For example, a misting system driven solely by the pressure of a municipal or other water supply at 60–50 psi (pounds per square inch) may produce a drizzle-like mist having droplets 100–250 microns in diameter.

Such a low-pressure system may be capable of reducing ambient temperature by 15° F. in a given atmosphere. Conversely, a misting system driven by a pump at around 1000 psi may produce a fog-like mist having droplets approximately 5 microns in diameter. Such a high-pressure system may be capable of reducing ambient temperature by 35° F. in the same atmosphere.

A misting system typically incorporates tubing or piping to convey the fluid (usually water) to the desired predetermined misting location. This tubing and associated apparatus (e.g., connectors, fittings, pumps, etc.) form a fluid-distribution (FD) subsystem of the misting system. The FD subsystem normally has a relatively large diameter (i.e., one-quarter to one-half inch standard tubing or piping) to permit relatively turbulent-free flow of the fluid at the required pressure. In normal practice, the diameter of the FD subsystem is a function of the size of the misting system. The greater the number of desired predetermined misting locations to which the fluid is to be distributed (i.e., the greater the fluid flow) and/or the distance between the fluid source and the farthest desired predetermined misting location, the larger the desired FD subsystem diameter. It will be recognized by those skilled in the art, however, that this is not an absolute rule. Other factors, such as tubing composition, fluid pressure, and environmental concerns, also have a bearing upon the diameter of the FD subsystem.

At the desired predetermined misting location, a misting system typically has a fitting with a nozzle coupled thereto. This fitting and nozzle, along with connectors, extensions, or other apparatus between the fitting and the nozzle, form a fluid-atomization (FA) subsystem of the misting system. The task of the FA subsystem is to render the fluid into a mist. This requires that the fluid be entrapped, fractured, and atomized. These are turbulent activities best isolated from the smooth flow of fluid in the FD subsystem. The FA subsystem, therefore, entraps the fluid in a connector or other apparatus having a very narrow diameter relative to the diameter of the FD subsystem. This isolates the turbulent activities of the FA subsystem from the smooth activities of the FD subsystem. Since the flow through an FA nozzle is very low, e.g., less than one and one-half gallon per hour in a typical high-pressure misting system, the small diameter of the FA subsystem has little effect on the resultant mist. A typical misting system has a plurality of such FA subsystems.

A problem arises, however, when it is desirous to produce a greater quantity of mist at a single predetermined misting location than is feasible with a conventional FA subsystem. Multiple interface fittings, hence multiple FA nozzles, may be placed in close proximity to provide increased misting capability. This multiple-fitting approach, however, generally produces less-than optimal results, and often produces unaesthetic layouts. In many cases, the requirements of the environment dictate the layout proximate the predetermined misting locations. In such cases, the multiple-fitting solution is contra-indicated.

A variation on the multiple-fitting approach is the branched-distribution approach. In the branched-distribution approach, short or specially shaped branches in the FD subsystem are implemented, with each branch having interface fittings and FA nozzles at the desired locations thereon proximate the preferred predetermined misting location. One example of this may be a cross (i.e., a double-tee) coupling two short secondary FD tubing to a primary FD tubing. Each secondary tubing may then have one or more interface fittings and FA nozzles. Similarly, a tee may couple a circular or serpentine secondary FD tubing having a plurality of interface fittings and FA nozzles.

Such multiple-FA subsystem approaches fail when retrofitting a pre-existing misting system or a misting system where the environment prohibits other than the primary FD tubing.

SUMMARY OF THE INVENTION

Accordingly, it is an advantage of the present invention that a misting-system fluid-atomization manifold is provided.

It is another advantage of the present invention that a misting-system fluid-atomization manifold is provided that allows increased misting at a predetermined misting location than is feasible with a single fluid-atomization nozzle.

It is another advantage of the present invention that a misting-system fluid-atomization manifold is provided that allows the coupling of a plurality of fluid-atomization nozzles to a single interface fitting.

It is another advantage of the present invention that a misting-system fluid-atomization manifold is provided that may be cascaded to allow increased misting over that allowed through the use of a single fluid-atomization manifold and associated fluid-atomization nozzles.

It is another advantage of the present invention that a misting-system fluid-atomization manifold is provided that allows an increase in the misting capabilities of an existing misting system.

The above and other advantages of the present invention are carried out in one form by a fluid-atomization manifold for use in a misting system formed of a fluid-distribution subsystem configured to distribute a fluid and a fluid-atomization subsystem, of which the fluid-atomization manifold is a component, configured to render the fluid into a mist. The fluid-atomization manifold includes a manifold input connector coupled to an output connector of an interface fitting within the fluid-atomization subsystem, and a plurality of manifold output connectors, wherein an input connector of each of a plurality of fluid-atomization nozzles within the fluid-atomization subsystem is configured to mate with the fitting output connector and is coupled to one of the manifold output connectors.

BRIEF DESCRIPTION OF THE DRAWINGS

A more complete understanding of the present invention may be derived by referring to the detailed description and claims when considered in connection with the Figures, wherein like reference numbers refer to similar items throughout the Figures, and:

DETAILED DESCRIPTION OF THE PREFERRED EMBODIMENTS

Figure 1:
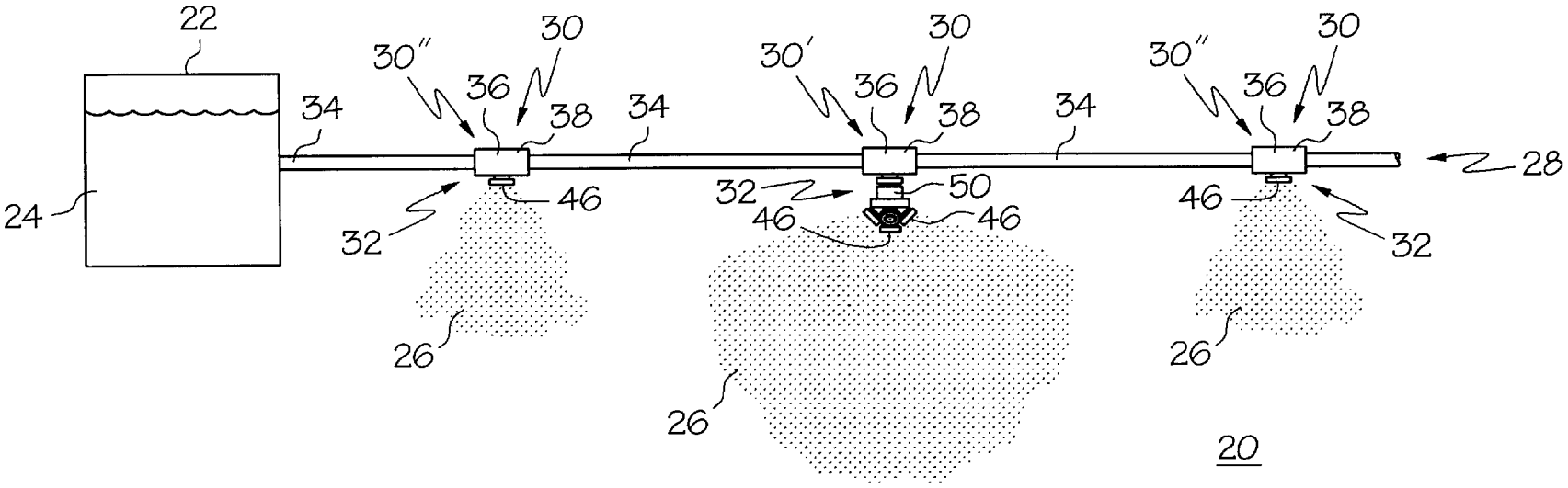
FIG. 1 shows a side view of a misting system in accordance with a preferred embodiment of the present invention.

FIG. 1 shows a side view of a misting system 20 in accordance with a preferred embodiment of the present invention. Misting system 20 is depicted in FIG. 1 in a simplified form for exemplary purposes only.

In misting system 20, a fluid source 22 provides a fluid 24 (typically water) to be rendered into a mist 26. Those skilled in the art will appreciate that fluid source 22, depicted schematically in FIG. 1, may be a municipal or private water supply (not shown) for low-pressure misting systems or, with the addition of a pump (not shown), for high-pressure misting systems.

Within misting system 20, a fluid-distribution (FD) subsystem 28 is configured to distribute fluid 24 from fluid source 22 to at least one predetermined location 30 where misting is desired. At substantially predetermined misting location 30, a fluid-atomization (FA) subsystem 32 is configured to render a portion of fluid 24 into mist 26. A typical embodiment of misting system 20 has a plurality of predetermined misting locations 30, hence a plurality of FA subsystems 32. Three such predetermined misting locations 30 and FA subsystems 32 are depicted in FIG. 1.

FD subsystem 28 is formed of FD tubing 34 configured to convey fluid 24 from fluid source 22 to and between predetermined misting locations 30, and those apparatus (couplers, connectors, fittings, etc.) used to connect, mount, and otherwise support FD tubing 34. FD subsystem 28 conveys fluid 24 to each predetermined misting location 30 within misting system 20 while generally maintaining system pressure. To accomplish this, FD tubing 34 (and associated apparatus) possesses a relatively large diameter. This maintains a quantity of fluid 24 within FD-subsystem 28 having little turbulence, i.e., a reservoir of fluid 24.

Figure 2:
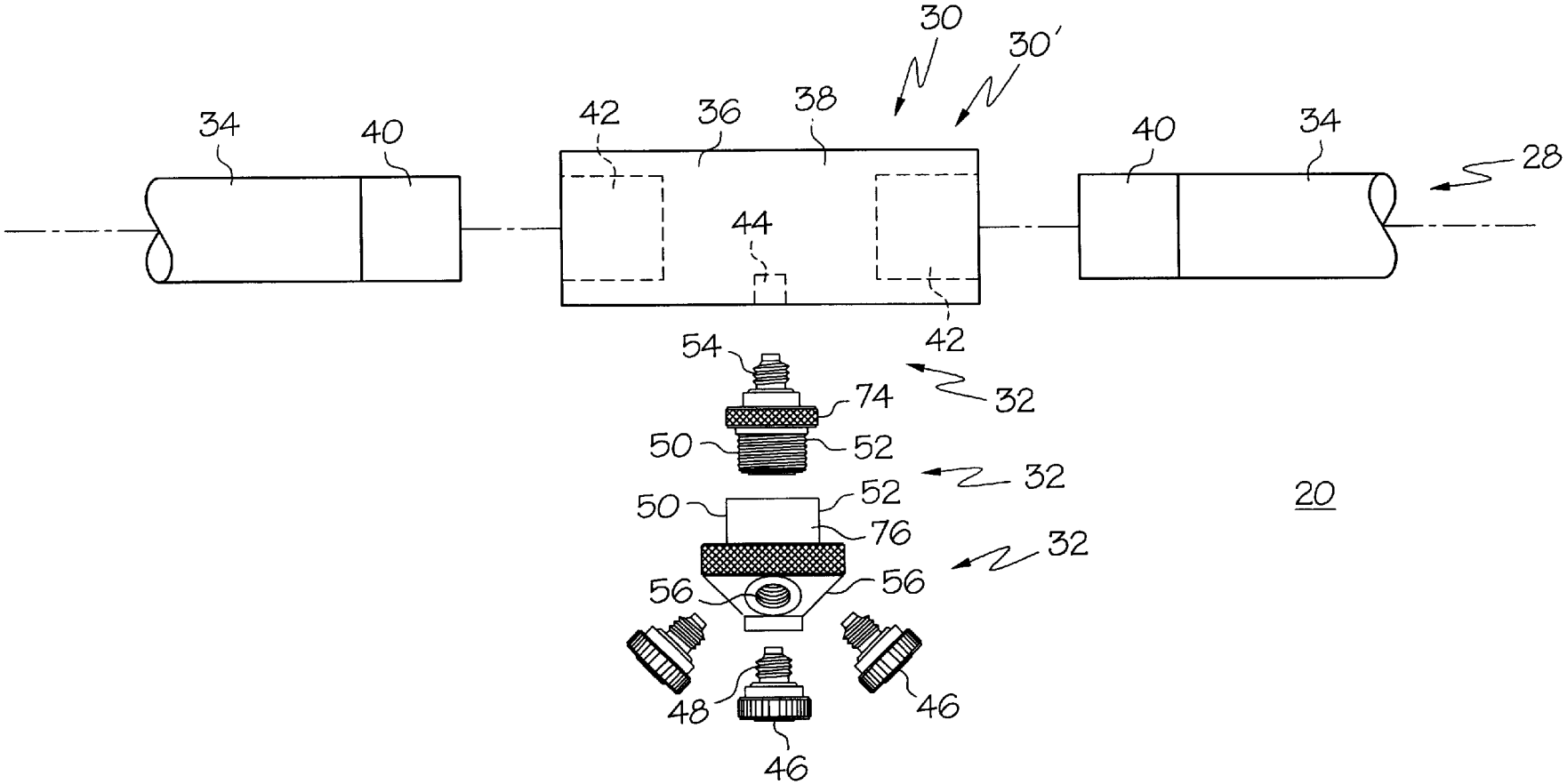
FIG. 2 shows an exploded side view of a portion of the misting system of FIG. 1 in accordance with a preferred embodiment of the present invention.

FIG. 2 shows an exploded side view of a portion of misting system 20 at a preferred predetermined misting location 30' in accordance with a preferred embodiment of the present invention. The following discussion refers to FIGS. 1 and 2.

An interface fitting 36 is coupled to FD tubing 34 at predetermined misting location 30'. Interface fitting 36 conveys fluid 24 between FD subsystem 28 and FA subsystem 32, i.e., serves as an interface between FD and FA subsystems 28 and 32.

Interface fitting need not be limited to an interfacing function. For example, in the preferred embodiment of FIGS. 1 and 2, interface fitting 36 also serves as an FD coupler 38 between sections of FD tubing 34. FD tubing 34 has FD-tubing connectors 40, and interface fitting 36 has FD-fitting connectors 42 configured to mate with FD-tubing connectors 40. When mated, FD connectors 40 and 42 join sections of FD tubing 34 through interface fitting (coupler) 36.

Those skilled in the art will appreciate that the method required to couple FD-tubing and FD-interface connectors 40 and 42 is not relevant to the present invention. The use of a given coupling method, e.g., threads, sweat soldering, glue, friction, etc., is dependent upon the characteristics and materials of the components of misting system 20 and does not depart from the spirit of the present invention.

In the preferred embodiment, interface fitting 36 takes the form of a tee. In addition to opposing FD-fitting connectors 42, FD fitting 36 also has an FA-fitting connector 44 as the stem of the tee. It is FA-fitting connector 44 that effects the interface between FD subsystem 28 and FA subsystem 32.

Those skilled in the art will appreciate that in some applications, interface fitting 36 may be integral with FD tubing 34. For example, FD tubing 34 may be thick-walled brass or steel tubing (i.e., pipe), and FA-fitting connector 44 may be a hole drilled into FD tubing 34 and threaded. In such a case, it will be understood that, for the purposes of this discussion, interface fitting 36 is that portion of FD tubing 34 proximate FA-fitting connector 44. FD-tubing and FD-fitting connectors 40 and 42 are then arbitrary delineation zones between FD tubing 34 and interface fitting 36. It will be understood that the use of such integral components does not depart from the spirit of the present invention.

It is the task of FA subsystem 32 to atomize fluid 24 into mist 26. An FA nozzle 46 (i.e., a misting nozzle) is that component of FA subsystem 32 configured to render fluid 24 into mist 26. Therefore, FA subsystem 32 requires at least one FA nozzle 46 proximate each predetermined misting location 30.

FA-fitting connector 44 is configured to mate with an FA-nozzle connector 48 on FA nozzle 46. Therefore, the simplest form of FA subsystem 32 is the coupling of FA nozzle 46 to interface fitting 36 via FA connectors 44 and 48. This is depicted in FIG. 1 at the first (leftmost) and third (rightmost) predetermined misting locations 30Δ. These embodiments of FA subsystem 32 produce normal clouds of mist 26.

When a greater cloud of mist 26 is desired at a single predetermined misting location 30' than can be effected by a single FA nozzle 46, then multiple FA nozzles 46 proximate that predetermined misting location are desirable. In the preferred embodiment, an FA manifold 50 allows the coupling of multiple FA nozzles 46 to interface fitting 36.

In the preferred embodiment, FA manifold 50 has a body 52 with an input connector 54 and a plurality of output connectors 56. FA-manifold input connector 54 is substantially identical to FA-nozzle connector 48, and is therefore also configured to mate with FA-fitting connector 44. Similarly, each FA-manifold output connector 56 is substantially identical to FA-fitting connector 44, and is therefore also configured to mate with any FA-nozzle connector 48.

FA-manifold input connector 54 is coupled to FA-fitting connector 44 (i.e., FA nozzle 50 is coupled to interface fitting 36). Therefore, FA manifold 50 is a component of FA subsystem 32, rather than a component of FD subsystem 28. The single FA-fitting connector 44 is effectively replaced with the plurality of FA-manifold output connectors. Each FA-nozzle connector 48 is then coupled to one of FA-manifold output connectors 56 (i.e., each FA nozzle 46 is coupled to FA manifold 50). The plurality of FA nozzles 46 then produce a greater cloud of mist 26 proximate predetermined misting location 30' than would be available from a single FA nozzle 46. This is depicted in FIG. 1 at the second (center) predetermined misting location 30'.

Figure 3:
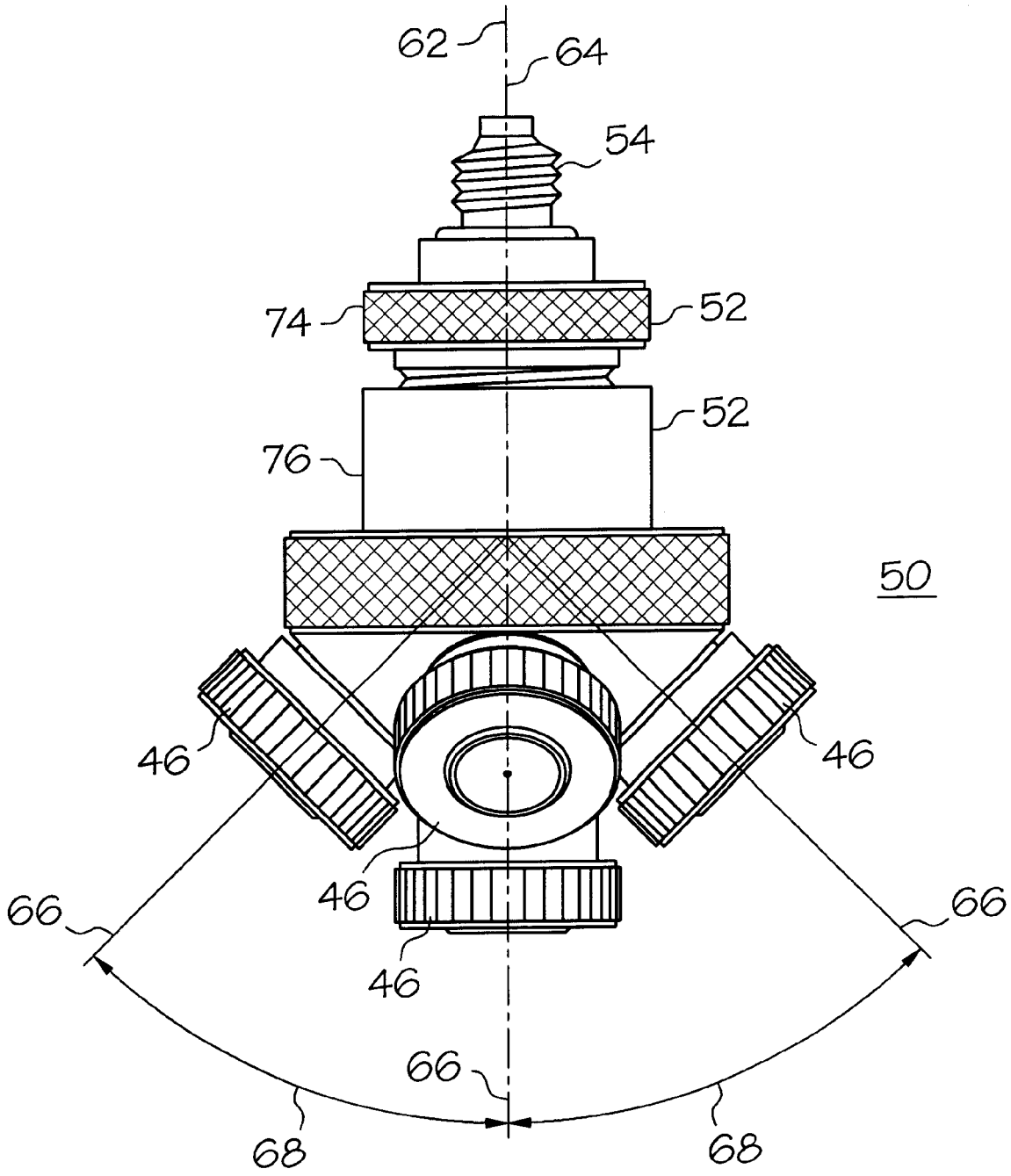
FIG. 3 shows a side view of a fluid-atomization manifold and a plurality of fluid-atomization nozzles of the misting system of FIG. 1 in accordance with a preferred embodiment of the present invention.
Figure 4:
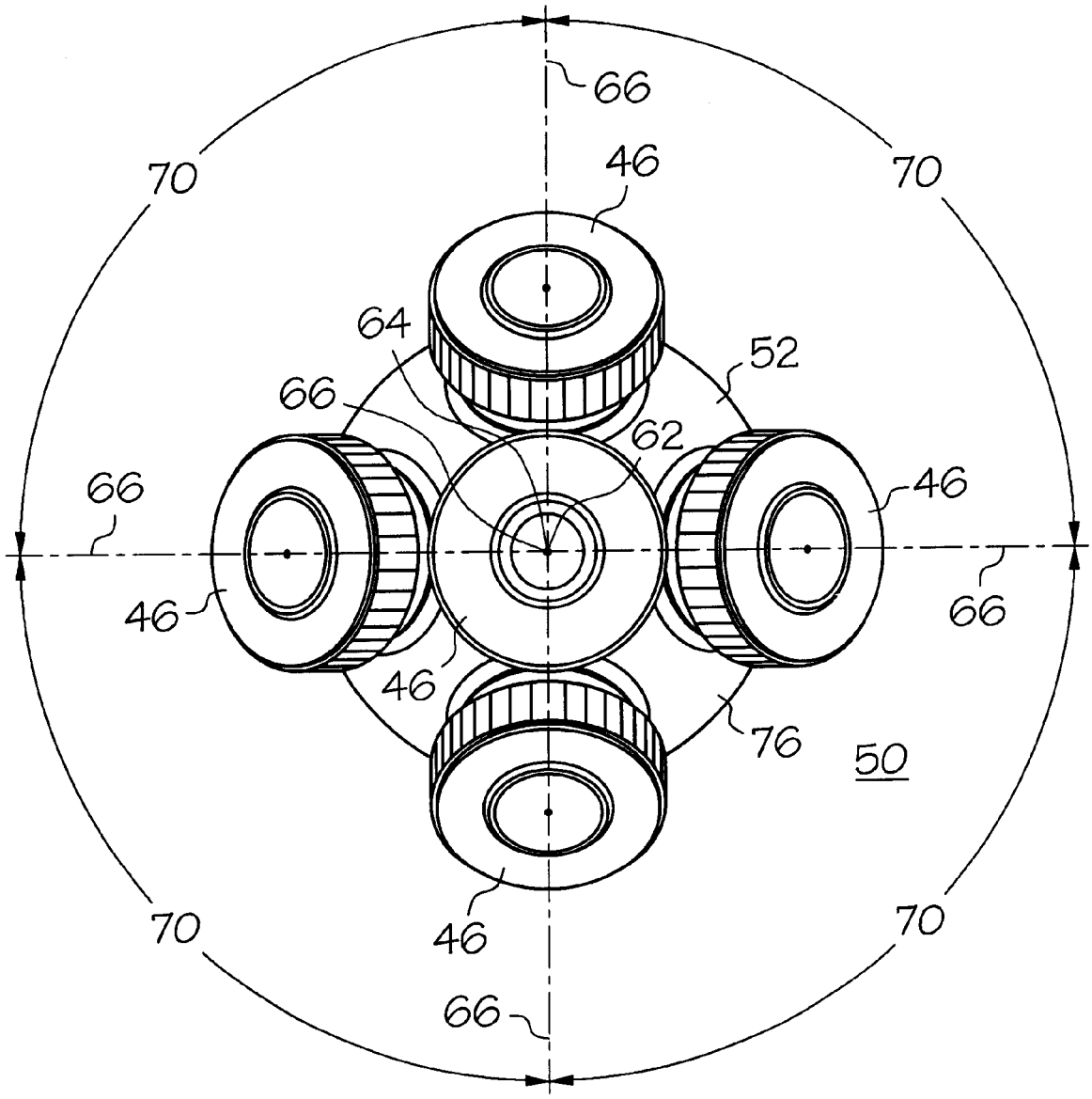
FIG. 4 shows an end view of the fluid-atomization manifold and fluid-atomization nozzles of FIG. 3 in accordance with a preferred embodiment of the present invention.
Figure 5:
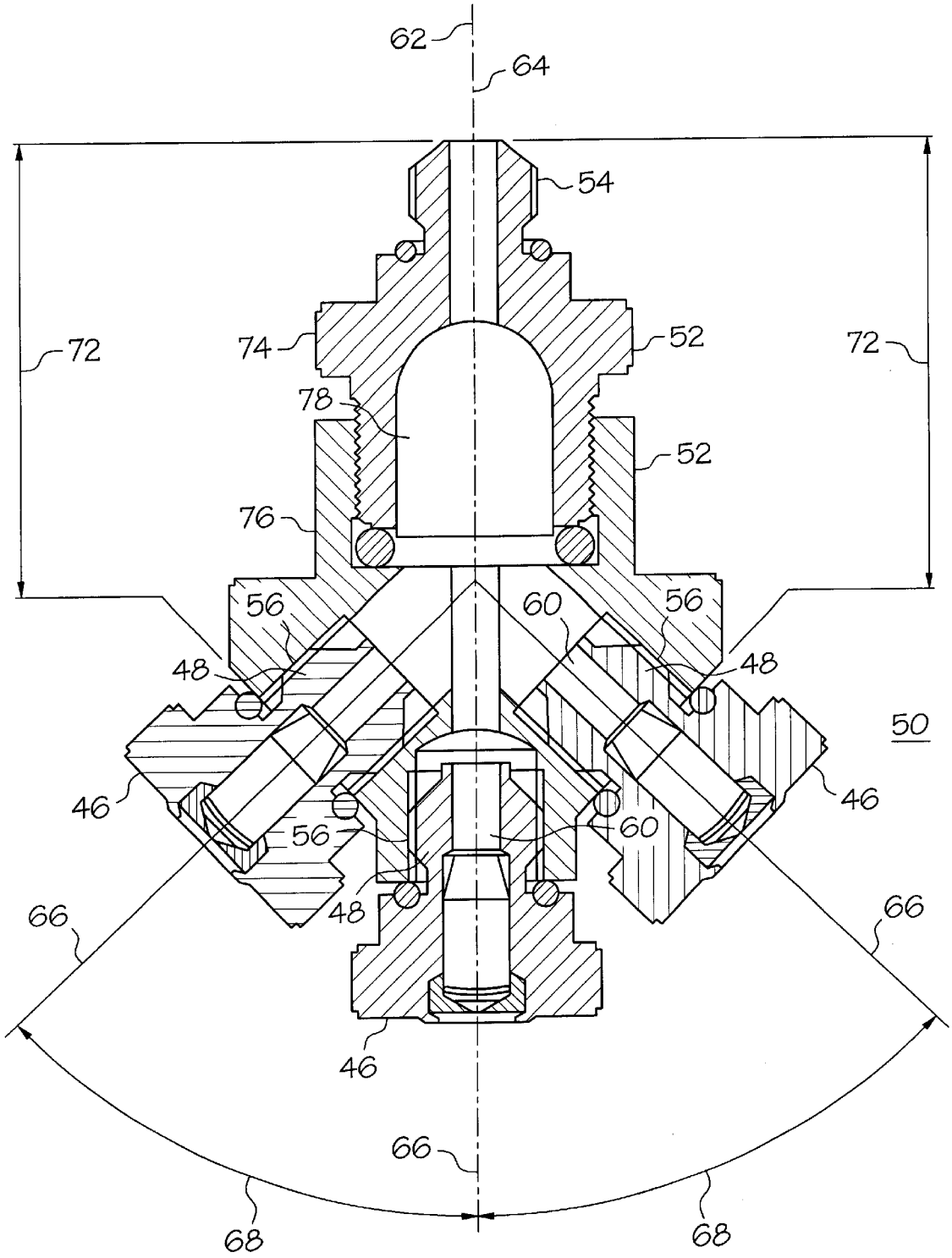
FIG. 5 shows a cross sectional side view of the fluid-atomization manifold and fluid-atomization nozzles of FIG. 3 in accordance with a preferred embodiment of the present invention.

FIG. 3 shows a side view, FIG. 4 shows an end view, and FIG. 5 shows a cross sectional side view of FA manifold 50 with a plurality of FA nozzles 46 coupled thereto in accordance with a preferred embodiment of the present invention. The following discussion refers to FIGS. 2 through 5.

In the preferred embodiment of FIGS. 2 through 5, FA manifold 50 has five output connectors 56. FA manifold 50 may therefore couple with up to five FA nozzles 46. FA subsystem 32 is therefore capable of producing roughly up to five times the volume of mist 26 it would be capable of producing with a single FA nozzle 46.

As depicted in FIG. 5, FA manifold 50 has a single input connector 54. FA-manifold input connector 54 has a fluid port 58 of a size comparable to a fluid port 60 of FA-nozzle connector 48. Therefore, when FA-manifold input connector 54 is coupled to FA-fitting connector 44, FA-manifold fluid port 58 presents substantially the same hydrodynamic characteristics to fluid 24 as would a single FA nozzle 46. Fluid ports 58 and 60 have small cross sections relative to the cross section of FD tubing 34 (see FIGS. 2 and 5). The small size of either FA fluid port 58 or 60 serves to entrap a small quantity of fluid 24 within FA subsystem 32 while isolating the remainder of fluid 24 in FD subsystem 28 from the fracturing and turbulence of fluid 24 within FA subsystem 32.

In the preferred embodiment of FIGS. 2 through 5, FA-manifold 50 has a central axis 62. When viewed along central axis 62 (FIG. 4), FA manifold 50 is symmetrically arrayed. FA-manifold input connector 54 (FIGS. 3, and 5) has an input-connector axis 64 that is substantially coincident with central axis 62. A central one of the five FA-manifold output connectors 56 has an output-connector axis 66 substantially coincident with input-connector axis 64, i.e., substantially coincident with central axis 62. Others of FA-manifold output connectors 56 have output-connector axes 66 substantially symmetrically radially arranged (FIG. 4) subtending substantially equal angles 68 (FIGS. 3 and 5) relative to input-connector axis 64. That is, in the preferred embodiment, the single central FA-manifold output-connector axis 66 subtends an input-to-output connector angle 68 (not shown) of substantially zero degrees and the four peripheral FA-manifold output-connector axes 66 subtend input-to-output angles 68 of substantially forty-five degrees at substantially ninety-degree output-to-output radial interval angles 70 relative to central axis 62.

Additionally, the peripheral FA-manifold output-connector axes 66 subtend substantially identical input-to-output angles 68 from substantially the same point 71 on input-connector axis 64. Therefore, input-to-output distances 72 from an entrance of FA-manifold input connector 54 to an exit of each peripheral FA-manifold output connector 56 are substantially equal.

FA manifold 50, being a component of FA subsystem 32, is small in size. FA manifold may easily be implemented so that the distance between any two FA-manifold connectors is less than two inches, and desirably less than one inch. This small size allows each of FA nozzles 46 coupled to FA manifold 50 to produce mist 26 at substantially predetermined misting location 30.

Those skilled in the art will appreciate that the spatial and angular relationships discussed herein in regards to FA manifold 50 are those of the preferred embodiment and therefore exemplary. Other spatial and angular relationships, e.g., other numbers of FA-manifold output connectors in other arrangements, may be used without departing from the spirit of the present invention.

In the preferred embodiment, FA-manifold body 52 is fabricated in two parts (FIGS. 2, 3, and 5): an input part 74, of which FA-manifold input connector 54 is a component; and an output part 76, of which FA-manifold output connectors 56 are components. An optional filter 78 (FIG. 5) may be coupled between input and output parts 74 and 76. Filter 78 may be a standard commercially available filter, such as a model X-6834 25-micron polyethylene filter from Porex Technologies. When filter 78 is in place and input part 74 is coupled to output part 76, then substantially all of fluid 24 entering FA-manifold input connector 54 passes through filter 78, and substantially all of fluid 24 passing through filter 78 exits FA manifold 50 via FA-manifold output connectors 56.

Those skilled in the art will appreciate that if filter 78 is not desired, then FA-manifold 50 may be integrally formed (i.e., FA-manifold body 52 may be one part). The use or nonuse of filter 78 does not depart from the spirit of the present invention.

Figure 6:
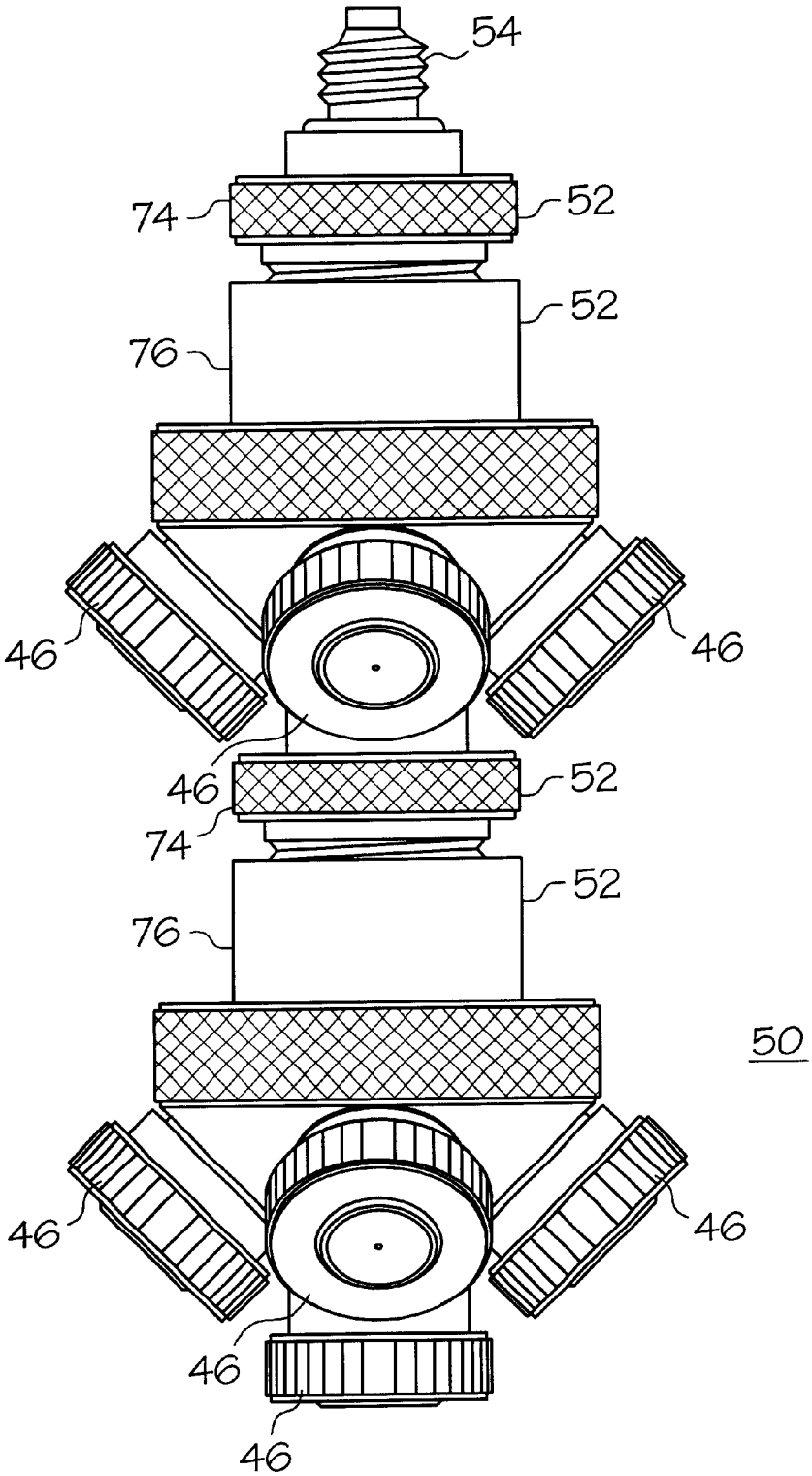
FIG. 6 shows a side view of cascaded fluid-atomization manifolds and nozzles in accordance with an alternative preferred embodiment of the present invention.

FIG. 6 shows a side view of cascaded FA manifolds 50, each with its own plurality of FA nozzles 46 coupled thereto, in accordance with an alternative preferred embodiment of the present invention. The following discussion refers to FIGS. 3 5 and 6.

In the alternative preferred embodiment of FIG. 6, a second FA manifold 50 is coupled into the central output connector 56 of a first FA-manifold 50. This makes available nine FA-manifold output connectors 56 to which up to nine FA nozzles 46 10 may be coupled: up to four FA nozzles 46 to the remaining output connectors 56 of the first FA manifold, and up to five FA nozzles 46 to the output connectors 56 of the second FA-manifold 50. In this embodiment, FA subsystem 32 is therefore capable of producing up to nine times the volume of mist 26 it would be capable of producing with a single FA nozzle 46.

Those skilled in the art will appreciate that the alternative embodiment of FIG. 6 is one of a plethora of alternative embodiments. The use of other alternative embodiments does not depart from the spirit of the present 20 invention.

Additionally, it will also be appreciated by those skilled in the art that components other than those depicted and/or discussed herein (e.g., nozzle extensions, etc.) may be incorporated without departing from the spirit of the present invention.

In summary, the present invention teaches a misting-system fluid-atomization (FA) manifold 50 and the integration thereof into a misting system 20. FA manifold 50 allows increased misting at a predetermined misting location 30 over that feasible with a single FA nozzle 46. FA manifold 50 further allows the coupling of a plurality of FA nozzles 46 to a single interface fitting 36 within misting system 20. FA manifold 50*s* may be cascaded to allow even greater increased misting by misting system 20.

Although the preferred embodiments of the invention have been illustrated and described in detail, it will be readily apparent to those skilled in the art that various modifications may be made therein without departing from the spirit of the invention or from the scope of the appended claims.

What is claimed is:

1. A manifold for use in a misting system formed of a fluid-distribution subsystem configured to distribute a fluid and a fluid-atomization subsystem configured to render said fluid into a mist, said manifold comprising:

an input connector having an input axis and configured to mate with a fitting connector of an interface fitting within said fluid-atomization subsystem; and at least three output connectors, wherein said input connector is configured to mate with said at least three output connectors, wherein a first one of said output connectors has a first output axis substantially coincident with said input axis, wherein a second one of said output connectors has a second output axis subtending an angle relative to said input axis, and wherein each of said output connectors is configured to mate with a nozzle connector of one of a plurality of nozzles within said fluid-atomization subsystem, each of said nozzle connectors being configured to mate with said fitting connector.

2. A manifold as claimed in claim 1 wherein:

said input connector is substantially identical to one of said nozzle connectors; and each of said output connectors is substantially identical to said fitting connector.

3. A manifold as claimed in claim 1 wherein:

said manifold is configured to be integrated into said misting system;

said input connector is coupled to said fitting connector to integrate said manifold into said misting system; and at least one of said output connectors is coupled to one of said nozzle connectors to integrate said manifold into said misting system.

4. A manifold as claimed in claim 1 wherein:

said manifold comprises a central axis;

said input axis is substantially coincident with said central axis;

said first output axis is substantially coincident with said central axis; and said second output axis subtends said angle relative to said central axis from a point on said central axis.

5. A manifold as claimed in claim 1 wherein:

said angle subtended by said second output axis is a first angle;

a third one of said output connectors has a third output axis subtending a second angle relative to said input axis; and said first and second angles are substantially identical.

6. A manifold as claimed in claim 4 wherein a distance from an entrance of said input connector to an exit of said first output connector is substantially equal to a distance from said entrance of said input connector to an exit of said second output connector.

7. A manifold as claimed in claim 1 wherein at least two of said output connectors have output axes substantially symmetrically radially arranged about said input axis.

8. A manifold as claimed in claim 1 wherein:

said first output axis subtends a first angle;

said angle subtended by said second output axis is a second angle;

said first angle is substantially zero degrees relative to a central axis of said manifold; and said second angle is substantially forty-five degrees relative to said central axis.

9. A manifold as claimed in claim 7 wherein said at least two output connectors are substantially symmetrically radially arranged about said input axis.

10. A manifold as claimed in claim 1 wherein each of said output connectors is located within two inches of each other of said output connectors and within four inches of said input connector.

11. A misting system formed of a fluid-distribution subsystem configured to distribute a fluid and a fluid-atomization subsystem configured to render said fluid into a mist, said misting system comprising:

a source of said fluid;

tubing coupled to said fluid source and configured to convey said fluid from said fluid source to substantially a predetermined misting location;

an interface fitting comprises a fitting connector, coupled to said tubing at substantially said predetermined misting location, and configured to convey said fluid between said fluid-distribution subsystem and said fluid-atomization subsystem;

a plurality of nozzles configured to render said fluid into said mist, each of said nozzles comprising a nozzle connector configured to mate with said fitting connector; and a manifold comprising an input connector configured to mate with and coupled to said fitting connector, and comprising at least three output connectors, each of said output connectors being configured to mate with and coupled to one of said nozzle connectors.

12. A misting system as claimed in claim 11 wherein:

said fitting connector is a first fitting connector;

said tubing comprises a tubing connector at substantially said predetermined misting location; and said interface fitting additionally comprises a second fitting connector configured to mate with and coupled to said tubing connector.

13. A misting system as claimed in claim 11 wherein:

said fitting connector is a first fitting connector;

said tubing comprises a tubing connector;

said interface fitting additionally comprises a second fitting connector coupled to said tubing connector; and each of said nozzle connectors is configured to mate with said first fitting connector.

14. A misting system as claimed in claim 13 wherein:

said input connector is substantially identical to each of said nozzle connectors and is coupled to said fitting connector; and each of said output connectors is substantially identical to said fitting connector and is coupled to one of said nozzle connectors.

15. A misting system as claimed in claim 14 wherein:

said fitting connector and said output connectors are female threaded connectors; and said input connector and said nozzle connectors are male threaded connectors.

16. A misting system as claimed in claim 11 wherein said manifold additionally comprises:

an input part comprising said input connector;

an output part comprising said output connectors and detachably coupled to said input part; and a filter coupled between said input and output parts.

17. A misting system as claimed in claim 11 wherein said manifold is a first manifold and said plurality of nozzles is a first plurality of nozzles, said misting system additionally comprising:

a second manifold coupled to said first manifold; and a second plurality of nozzles coupled to said second manifold and configured to render additional amounts of said fluid into said mist.

18. A misting system as claimed in claim 16 wherein:

a portion of said fluid enters said manifold via said input connector;

substantially all of said fluid entering said manifold via said input connector is filtered by said filter; and substantially all of said fluid filtered by said filter exits said manifold via said output connectors.

19. A manifold for use in a misting system configured to distribute a fluid and to render said fluid into a mist, said manifold comprising:

an input connector having an input axis and configured to mate with a fitting connector of an interface fitting of said misting system; and a plurality of output connectors, wherein said input connector is configured to mate with said plurality of output connectors, wherein one of said output connectors has an output axis substantially coincident with said input axis, wherein others of said output connectors have output axes subtending angles relative to said input axis and symmetrically radially arranged about said input axis, and wherein each of said output connectors is configured to mate with a nozzle connector of one of a plurality of nozzles of said misting system.

* * * * *